US008011360B2

(12) United States Patent
Desi-Seulean et al.

(10) Patent No.: US 8,011,360 B2
(45) Date of Patent: Sep. 6, 2011

(54) VENTED, GAS-FIRED AIR HEATER

(75) Inventors: Sergiu Desi-Seulean, Coaldale (CA); David Wiebe-Neufeldt, Lethbride (CA)

(73) Assignee: Haul-All Equipment Ltd., Alberta (CA)

( * ) Notice: Subject to any disclaimer, the term of this patent is extended or adjusted under 35 U.S.C. 154(b) by 1189 days.

(21) Appl. No.: 11/639,440

(22) Filed: Dec. 14, 2006

(65) Prior Publication Data

US 2009/0050291 A1 Feb. 26, 2009

(30) Foreign Application Priority Data

Dec. 16, 2005 (CA) ..... 2530544

(51) Int. Cl.

| | |
|---|---|
| ***F24H 3/00*** | (2006.01) |
| ***F24H 3/02*** | (2006.01) |
| ***F24H 3/12*** | (2006.01) |
| ***F23Q 2/00*** | (2006.01) |
| ***F28F 3/00*** | (2006.01) |
| ***F28F 1/00*** | (2006.01) |
| ***F28D 7/02*** | (2006.01) |

(52) U.S. Cl. ..... 126/116 R; 126/110 R; 126/90 R; 126/117; 431/143; 431/253; 431/350; 431/351; 431/353; 431/187; 431/8; 165/165; 165/166; 165/170; 165/177; 110/302

(58) Field of Classification Search ..... 126/116 R, 126/110 R, 90 R, 117; 431/143, 253, 350, 431/351, 353, 187, 8; 165/165, 166, 170, 165/177; 110/302

See application file for complete search history.

(56) References Cited

U.S. PATENT DOCUMENTS

| | | | | | |
|---|---|---|---|---|---|
| 2,857,906 | A * | 10/1958 | Davidson et al. | ..... | 126/110 B |
| 4,259,058 | A * | 3/1981 | Gottwald et al. | ..... | 431/220 |
| 4,577,615 | A * | 3/1986 | Tomlinson | ..... | 126/99 A |
| 4,739,746 | A * | 4/1988 | Tomlinson | ..... | 126/110 R |
| 5,979,433 | A * | 11/1999 | O'Brien | ..... | 126/116 R |
| 6,516,874 | B2 * | 2/2003 | Mathur et al. | ..... | 165/166 |
| 2004/0182556 | A1 * | 9/2004 | Jahn et al. | ..... | 165/166 |

* cited by examiner

*Primary Examiner* — Kenneth B Rinehart
*Assistant Examiner* — William G Corboy, III
(74) *Attorney, Agent, or Firm* — Dinsmore & Shohl LLP

(57) ABSTRACT

A vented, gas-fired air heater especially designed for temporary heating applications includes an improved burner design providing effective air and gas mixing and efficient burning in the combustion chamber. Highly efficient heat exchanger including corrugated heat exchanger panels provides enhanced heat transfer characteristics.

9 Claims, 10 Drawing Sheets

VENTED, GAS-FIRED AIR HEATER

BACKGROUND OF THE INVENTION

The present invention is directed toward improvements in indirect fired, vented air heaters.

There are generally two categories of gas-fired heaters, direct-fired and indirect-fired (or vented) heaters. With a direct-fired heater, the products of combustion are released into the heated space. With an indirect-fired heater, some form of heater exchanger is used to transfer the heat from the combustion gases to the heated space. The combustion gases are vented out of the heated area.

Gas-fired heaters used in temporary heating applications, such as on construction sites, have generally been of the direct-fired type. There is currently an increasing demand for indirect-fired heaters for such applications. There is also an increasing demand for more energy efficient heaters. As a rule, heaters of higher efficiency are also much larger in size. The challenge is to have a relatively small yet efficient heater that can be used in temporary applications. Since temporary heaters are used seasonally, a smaller size would provide the benefit of reduced costs for off-season storage.

SUMMARY OF THE INVENTION

The objects of this invention are to provide a heater that:

has a highly efficient heat exchanger with enhanced heat transfer characteristics.

has an improved burner design providing a relatively short distance between the burner inlet and the flame.

provides a venturi action in the burner air flow at the burner head to promote air and gas mixing and efficient burning in the combustion chamber.

is economical to produce and operate.

is compact in size, with a relatively small footprint.

has a rugged construction that allows it to stand up to rigors both of transportation between sites and of being used in applications such as construction sites.

A gas burner in accordance with one aspect of the invention includes an enclosure defining a path for movement of combustion air. A pair of generally parallel burner plates are disposed transverse to the path of combustion air travel. The burner plates are spaced apart to define a shallow chamber therebetween and both plates have a plurality of openings therein allowing for passage of combustion air therethrough. The openings in a first one of said plates are aligned with respective ones of the openings in the second plate to provide annular openings allowing exit of gaseous fuel from the shallow chamber. A conduit supplies gaseous fuel into the shallow chamber defined between said burner plates such that, in use, combustion air moving along the path and through the aligned openings in said burner plates mixes with gaseous fuel emerging from said chamber via said annular openings thereby to provide a combustible fuel-air mixture downstream of said burner plates.

The openings in said plates are preferably in the form of short tubular collars projecting from said plates with the tubular collars of both plates being aligned with and directed toward each other in confronting spaced apart relation to provide said annular openings allowing exit of gaseous fuel between the confronting spaced apart collars.

In another aspect of the invention, the first burner plate is located upstream of the second burner plate relative to the flow direction of combustion air when in use. The tubular collars of the first burner plate define flow passages of smaller diameter than those defined by the tubular collars of the second plate thereby to create a venturi-like flow action as the combustion air passes through the aligned tubular collars thus promoting thorough mixing of the air and the gaseous fuel being supplied via said annular gaps as well as allowing for reduced gas supply pressure to the shallow chamber between the burner plates as the venturi action pulls the gas into the moving combustion air streams. This is the reverse of traditional venturi burners where higher gas pressures are used to draw combustion air in.

The short tubular collars are ideally integrally formed with their respective burner plates.

The burner plates are preferably of generally circular outline, with said conduit to supply gaseous fuel being connected centrally of said plates to supply the fuel to the chamber defined between said plates. The conduit preferably has an end portion centrally disposed between said burner plates and having a plurality of radially arranged openings to assist in providing even distribution of gaseous fuel to said chamber.

The blower preferably includes a vaned rotor mounted for rotation on an axis generally centered with said burner plates and extending normal thereto. Air flow confining structures are shaped to direct the air flow from said rotor generally along said axis whereby to deliver a generally even and balanced flow toward the burner plates to promote even flow distribution through said openings therein.

In accordance with another aspect of the invention there is provided a heat exchanger section comprising a pair of metal panels disposed in close face-to-face relation to allow gases to flow therebetween from an inlet end to an outlet end in a travel direction. The panels each have undulations or corrugations therein whereby gases flowing between said panels in the travel direction are forced to move in a turbulent fashion to enhance transfer of heat between said panels and the flowing gases.

In a preferred form of the invention said panels each have corrugations therein angled relative to the travel direction and oppositely oriented with respect to each other such that adjacent corrugations are in a criss-cross relation to each other whereby gases flowing between said panels are forced by the opposing corrugations to move in the form of a series of repeating spirals from said inlet end to said outlet end to provide enhanced heat transfer. The corrugations are preferably of a generally V-shaped or zig-zag configuration when seen end-on and are disposed at a relatively shallow acute angle relative to a line normal to the travel direction. In one preferred embodiment, said acute angle is approximately 9 degrees with said adjacent corrugations being at an angle of approximately 18 degrees relative to each other.

An air heater combination in accordance with a further aspect of the invention comprises a main housing having an air inlet and an outlet for heated air and a combustion chamber located therein. A burner assembly is connected to the combustion chamber to supply burning gases thereto. An exhaust stack is provided and a heat exchanger is connected to said combustion chamber and comprises a plurality of heat exchanger sections having inlet ends connected to receive heated combustion gases from the combustion chamber and outlet ends connected to said exhaust stack for exhausting combustion gases after passage through the heat exchanger sections. The heat exchanger sections are spaced apart to allow the passage of air therebetween to effect heating of same. A blower assembly moves cool air into said main housing via said air inlet and causes the air to travel between the heat exchanger sections and thence outwardly of said outlet for heated air.

The heat exchanger sections of the air heater each preferably comprise metal panels having corrugations or undulations therein arranged to cause combustion gases moving therethrough to move in a turbulent fashion to enhance transfer of heat from the gases to the metal panels while also causing turbulence in the air being heated as it travels between the heat exchanger sections and enhancing heat transfer from the metal panels to the air being heated.

In a typical embodiment, the heat exchanger sections are disposed, in use, in vertically spaced horizontal planes to provide for said passage of air along spaced horizontal planes during heating thereof.

Each said heat exchanger section in a preferred form of the invention comprises a pair of metal panels disposed in close face-to-face relation to allow gases to flow therebetween from the inlet ends to the outlet ends in a travel direction. Said panels each have corrugations therein angled relative to the travel direction and oppositely oriented with respect to each other such that adjacent corrugations are in a criss-cross relation to each other whereby gases flowing between said panels are forced by the opposing corrugations to move in the form of a series of repeating spirals from said inlet end to said outlet end to provide enhanced heat transfer.

The combustion chamber is preferably arranged in the main housing such that cool air entering via said air inlet travels partly around the combustion chamber exterior and receives heat therefrom prior to passing between said heat exchanger sections.

An air heater according to a further aspect of the invention comprises a main housing having an air inlet and an outlet for heated air, a combustion chamber located therein, a burner assembly connected to the combustion chamber to supply burning gases thereto, an exhaust stack, a heat exchanger connected to said combustion chamber and comprising a plurality of heat exchanger sections having inlet ends connected to receive heated combustion gases from the combustion chamber and outlet ends connected to said exhaust stack for exhausting combustion gases after passage through the heat exchanger sections. Said heat exchanger sections are spaced apart to allow the passage of air therebetween to effect heating of same. A blower assembly moves cool air into said main housing via said air inlet and causes the air to travel between the heat exchanger sections and thence outwardly of said outlet for heated air. Said burner assembly includes an enclosure connected to the combustion chamber and defines a path for movement of combustion air toward the combustion chamber. A pair of generally parallel burner plates are disposed transverse to the path of combustion air travel. Said burner plates are spaced apart to define a shallow chamber therebetween and both plates have a plurality of openings therein allowing for passage of combustion air therethrough. The openings in a first one of said plates are aligned with respective ones of the openings in the second plate to provide annular openings allowing exit of gaseous fuel from the shallow chamber. A conduit supplies gaseous fuel into the shallow chamber defined between said burner plates such that, in use, combustion air moving along the path and through the aligned openings in said burner plates mixes with gaseous fuel emerging from said chamber via said annular openings thereby to provide a combustible fuel-air mixture downstream of said burner plates, which mixture, in use, is ignited to provide the supply of burning gases to said combustion chamber.

The air heater burner preferably is constructed such that said openings in said plates are in the form of short tubular collars projecting from said plates with the tubular collars of both plates being aligned with and directed toward each other in confronting spaced apart relation to provide said annular openings allowing exit of gaseous fuel between the confronting spaced apart collars.

The air heater burner is typically arranged with said first burner plate located upstream of the second burner plate relative to the flow direction of combustion air when in use, and wherein the tubular collars of the first burner plate define flow passages of smaller diameter than those defined by the tubular collars of the second plate thereby to create a venturi-like flow action as the combustion air passes through the aligned tubular collars thus promoting thorough mixing of the air and the fuel being supplied via said annular gaps.

The air heater burner plates may be of generally circular outline, with said conduit to supply gaseous fuel being connected centrally of said plates to supply the fuel to the chamber defined between said plates, said conduit having an end portion centrally disposed between said burner plates and having a plurality of radially arranged openings to assist in providing even distribution of gaseous fuel to said chamber.

The air heater typically employs a burner blower communicating with said enclosure to provide for movement of combustion air along said path of travel toward said burner plates and combustion chamber. The burner blower preferably includes a vaned rotor mounted for rotation on an axis generally centered with said burner plates and extending normal thereto, the burner enclosure having a portion shaped to direct the air flow from said rotor generally along said axis whereby to deliver a generally even and balanced flow toward the burner plates to promote even flow distribution through said openings therein.

The air heater heat exchanger sections each preferably comprise metal panels having corrugations or undulations therein arranged to cause combustion gases moving therethrough to move in a turbulent fashion to enhance transfer of heat from the gases to the metal panels. These heat exchanger sections are disposed in a typical embodiment in vertically spaced horizontal planes to provide for said passage of air along spaced horizontal planes during heating thereof. The metal panels preferably have corrugations therein angled relative to the travel direction and oppositely oriented with respect to each other such that adjacent corrugations are in a criss-cross relation to each other whereby gases flowing between said panels are forced by the opposing corrugations to move in the form of a series of repeating spirals from said inlet end to said outlet end to provide enhanced transfer of heat.

DETAILED DESCRIPTION OF PREFERRED EMBODIMENT

Figure 1:
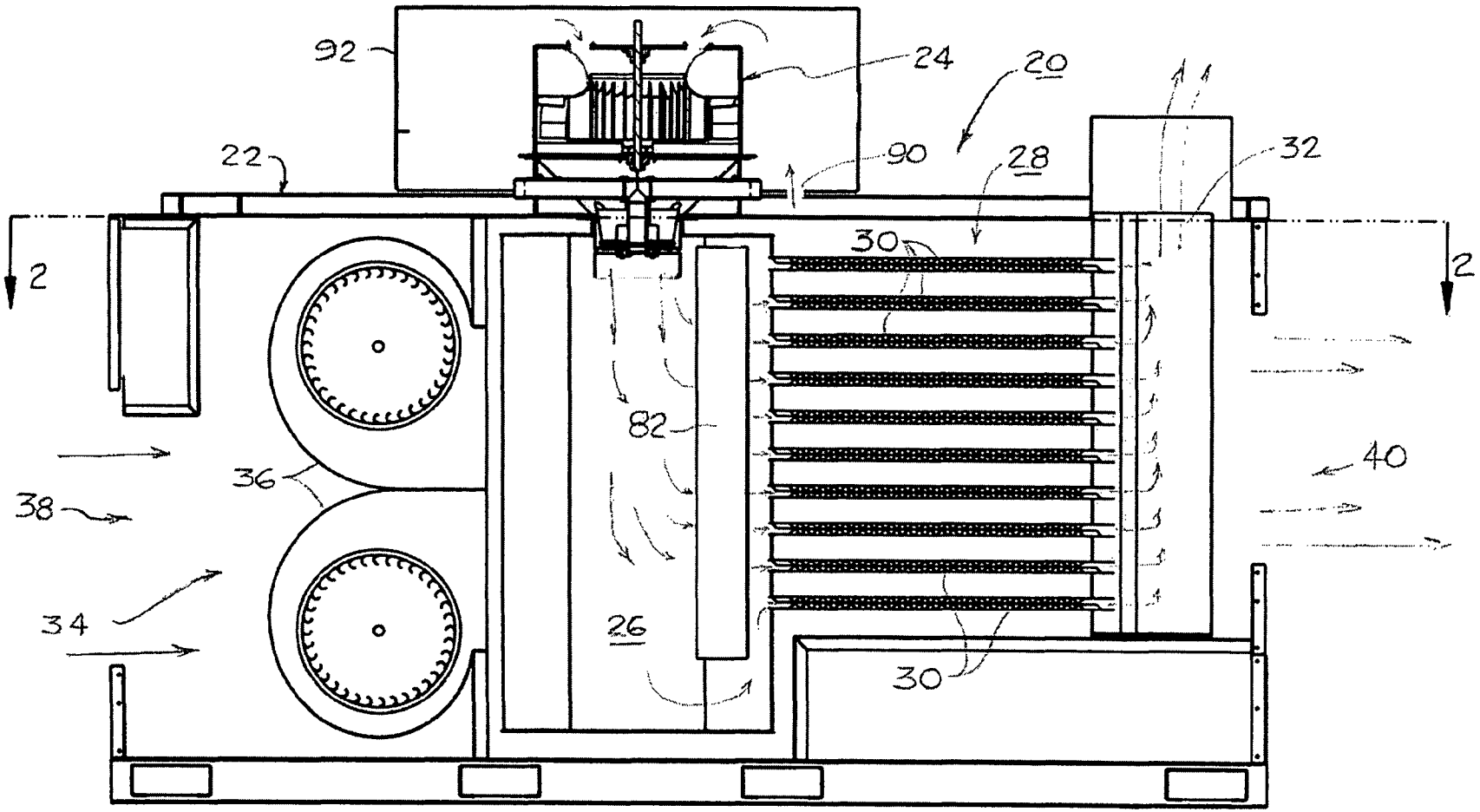
FIG. 1 is a longitudinal section view of the complete air heater taken in a vertical plane.

The indirect fired, vented air heater 20 includes a rectangular box-like main heater housing 22 having a burner assembly 24 mounted on an upper portion thereof and with a vertically disposed combustion chamber 26 disposed within the main housing. A heat exchanger 28 is connected to the combustion chamber 26 and extends laterally outwardly therefrom. The combustion chamber is positioned vertically within the main housing 22 with the burner assembly 24 positioned above and connected to the combustion chamber with the lower end of the burner assembly projecting into the upper end of the combustion chamber. The heat exchanger 28 includes a series of vertically spaced formed sections 30 which will be described hereafter. These sections 30 are connected in sealed relationship to slot-like openings in the walls of the combustion chamber on one side and to slot-like openings which are provided in the walls of a vertically arranged exhaust stack 32 located in spaced relation to the combustion chamber. A blower assembly 34 in the form of a pair of relatively large blower fans 36 is positioned to the side of the combustion chamber 26 which is opposite to the side where the heat exchanger 28 is positioned. The inlet end of the main heater housing 22 is provided with a rectangular inlet opening 38 for fresh cool air which is drawn inwardly by the blower fans 36, forced around the exterior of the combustion chamber and then caused to pass between the spaced apart heat exchanger sections 30, with the heated air then passing through a similarly sized warm air exit opening 40 in the exit or outlet end of the heater housing 22.

It will be appreciated that the indirect fired heater being described may be made in a variety of shapes and sizes while still retaining the basic innovative features to be described in detail hereafter. For example, one particular unit having a heating capacity of 1,500,000 BTU/hr., and fueled by either natural gas or propane, had overall heater housing dimensions of approximately 114 inches long by 32.5 inches wide by 77.5 inches high with a weight of 1,875 lbs. The above-mentioned cool air and warm air inlet and outlet openings 38, 40 at opposing ends of the housing were each 24 inches high by 24 inches wide. The air flow provided by the above-mentioned blowers 36 (without duct work and at 20° C.) was in the order of 7300 $ft^3$ per minute. The air temperature rise (without duct work) was 95° C. (171° F.) while the stack temperature rise was measured as 192° C. (345° F.). These figures are given merely by way of example and will of course vary widely depending on the size and exact design of the unit selected.

Figure 3:
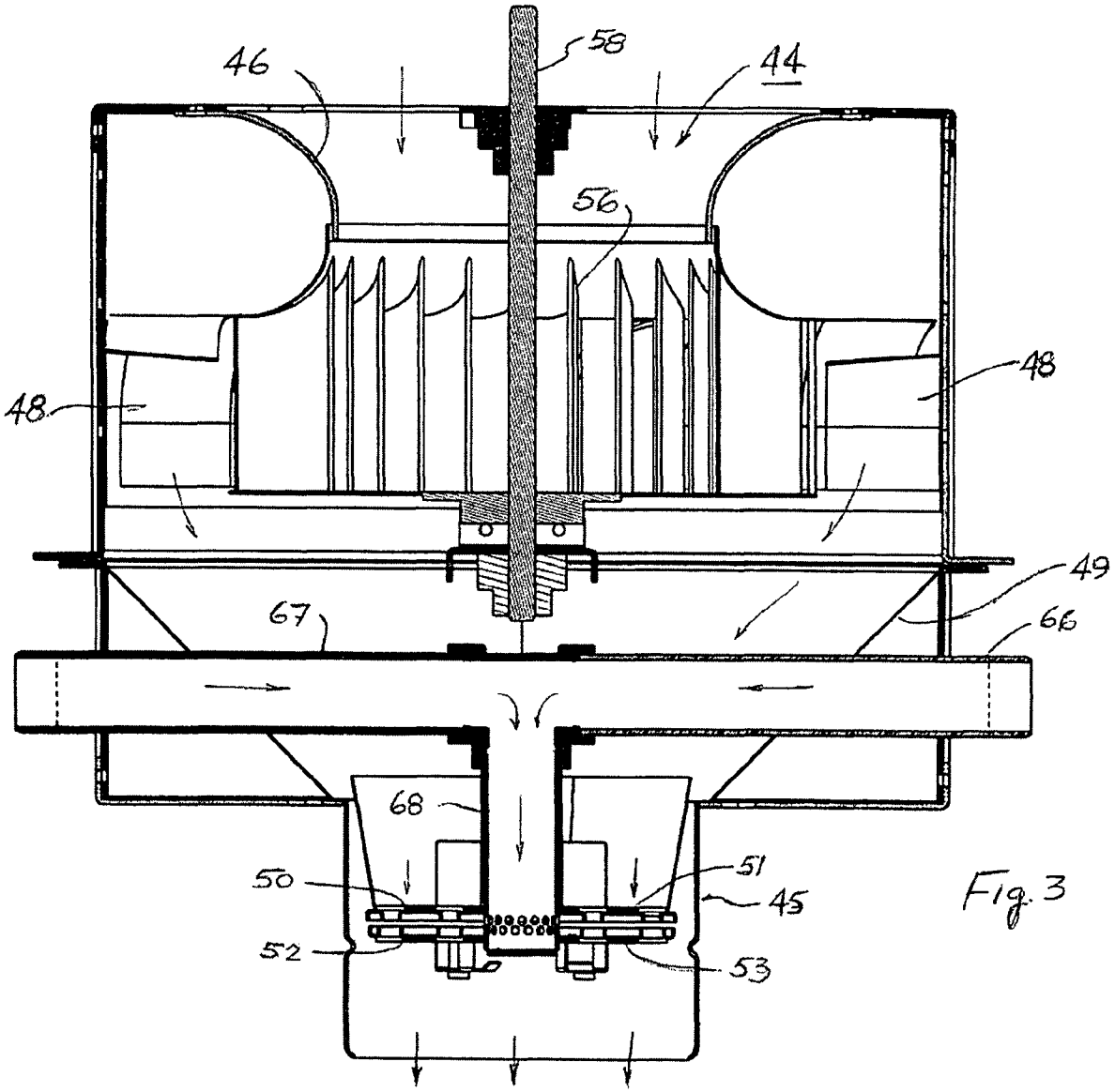
FIG. 3 is a section view of the burner assembly.

The gas burner assembly 24 (FIG. 3) includes a burner blower 44 positioned above the burner head 45. The burner blower 44 is provided with suitable air flow confining structures 46 including flow straightening vanes 48 and conical section 49 defining a path for movement of combustion air downwardly toward the burner head having a pair of generally parallel burner head plates 50,52 and disposed transverse to the path of combustion air travel. Burner plates 50, 52 are provided with upper and lower support plates 51, 53 respectively, to stiffen the burner head assembly and prevent warping of same, etc. It will be seen that the vaned burner blower rotor 56 is mounted for rotation on an axis defined by its vertical drive shaft 58 and is generally centered with the above-mentioned burner plates 50, 52 and extending normal thereto. (The drive shaft motor is not shown). The air flow confining structures 46 and vanes 48 are shaped to direct the air flow from the rotor 56 generally along this vertical axis thereby to deliver a generally even and balanced flow toward the burner plates 50, 52 to promote even flow distribution through the openings therein which will be hereafter described.

Figure 4:
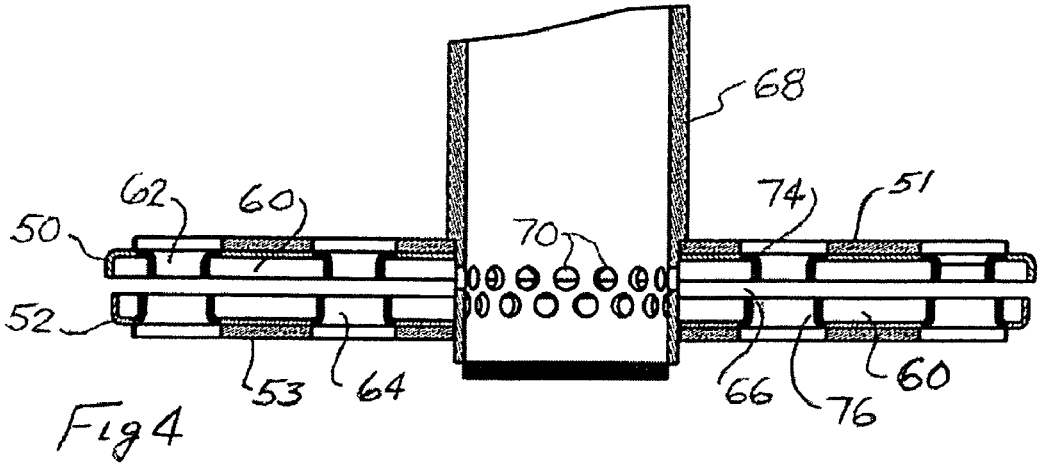
FIG. 4 is a partial section view of the burner assembly showing the burner plates and gas feed assembly.
Figure 5:
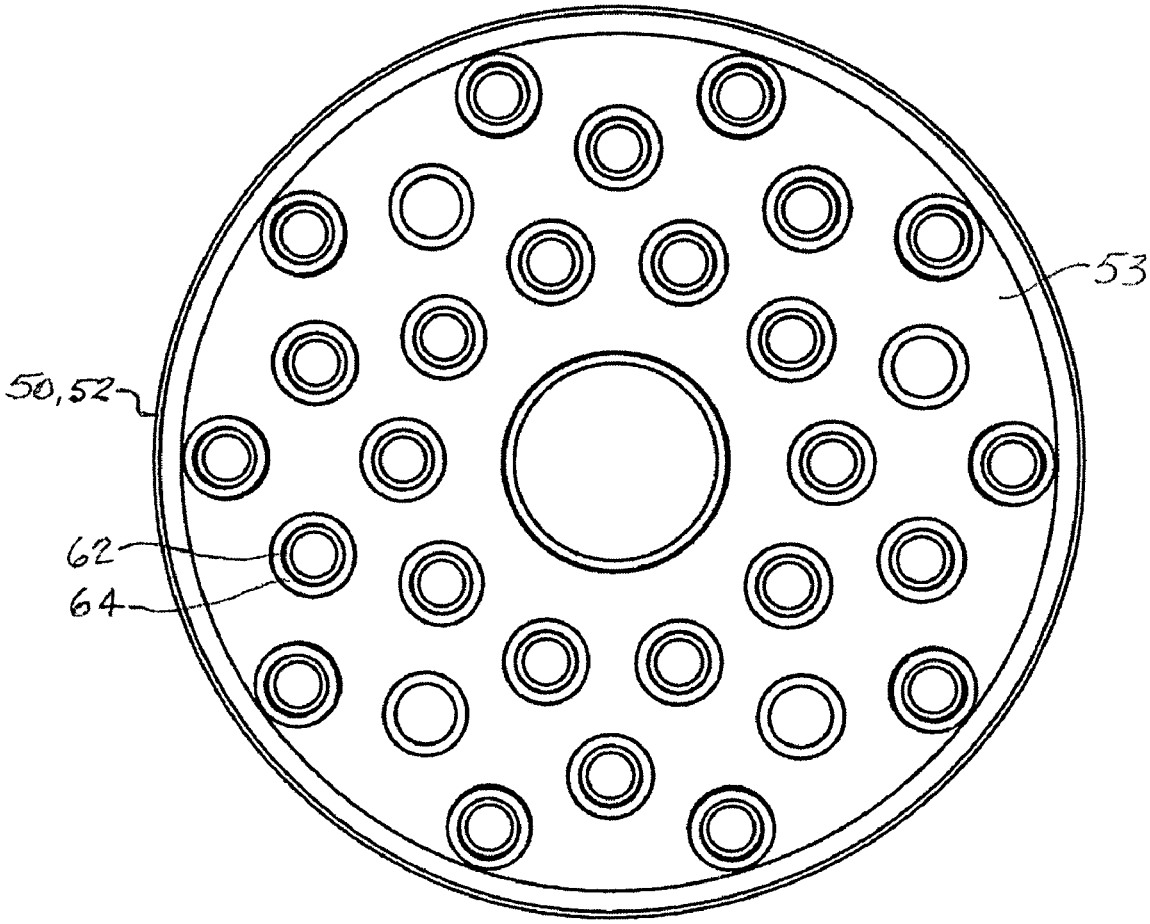
FIG. 5 is a bottom plan view of the burner plate structure of FIG. 4.
Figure 6:
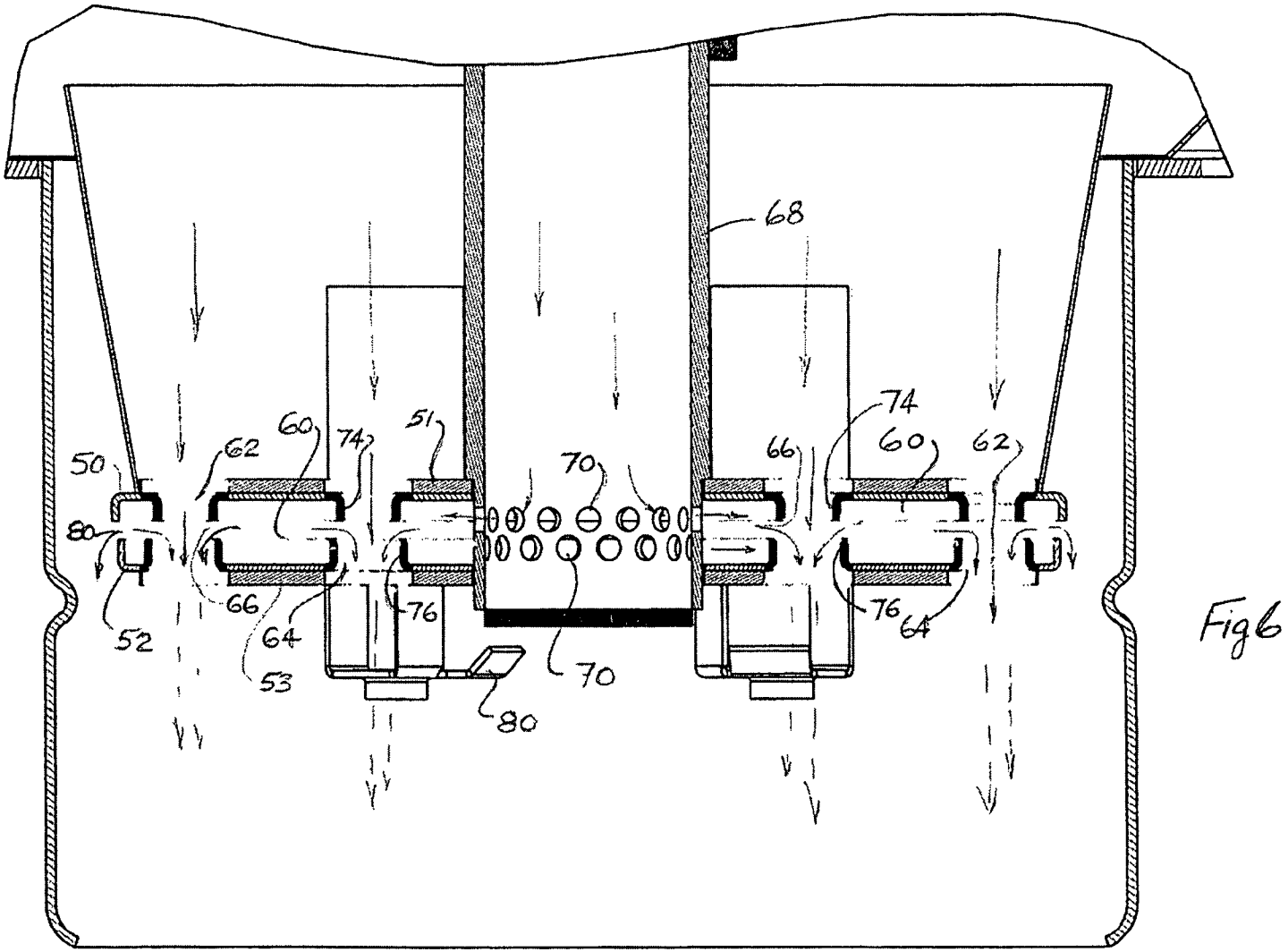
FIG. 6 is a further section view of the burner head assembly showing gas/air flows.

As best seen in FIGS. 3-6, the burner plates 50, 52 are of generally circular outline shape and they are spaced apart to define a shallow chamber 60 between them (FIGS. 4 and 6). Both plates have a multiplicity of openings 62, 64 therein allowing for passage of combustion air from the burner blower 44 therethrough. The openings 62 in a first one of the plates 50 are aligned with respective ones of the openings 64 in the second plate 52 to provide annular openings 66 allowing exit of gaseous fuel from the shallow chamber 60 defined between the plates. The gaseous fuel (either propane or natural gas) is provided by way of a pipe 67 which is located just above the burner plates 50, 52 and which is connected by a tee connection to a vertical conduit 68 having openings in its lower end to supply the gaseous fuel centrally of the burner plates 50, 52 in such a way as to provide a generally uniform supply to them. As shown in the drawings (FIGS. 3, 4, 6), this centrally connected conduit 68 has a lower end portion disposed between the burner plates (50, 52) which is provided with a multiplicity of radially arranged openings 70 to provide even distribution of gaseous fuel to the chamber 60 between the plates 50, 52. During operation, combustion air moving along the path of combustion air travel from the burner blower 44 enters through the aligned openings 62, 64 in the burner plates and mixes with the gaseous fuel emerging from between the burner plates via the above-mentioned annular openings 66 thereby to provide a combustable fuel-air mixture downstream of the burner plates.

The above-mentioned openings 62, 64 in the burner plates 50, 52 are in the form of short tubular collars 74, 76 projecting from the plates with the tubular collars of both plates being aligned with and directed toward each other in confronting spaced apart relation to provide the above-noted annular openings 66 allowing exit of gaseous fuel between the confronting spaced apart collars. In greater detail, the first burner plate 50 is located upstream of the second burner plate 52 relative to the flow direction of combustion air, when in use, and it is important to note that the tubular collars 74 of this first burner plate 50 define flow passages which are smaller in diameter than those defined by the tubular collars 76 of the second plate 52. Hence, by virtue of their relationship as shown in the drawings and described above, there is created a venturi-like flow action as the combustion air passes through the aligned tubular collars 74, 76 of the two burner plates 50, 52 thus promoting thorough mixing of the air and the gaseous fuel being supplied by the annular openings noted above and illustrated in FIG. 6 as well as allowing for reduced gas supply pressure between the burner plates as the venturi action pulls the gas into the moving combustion air streams.

The short tubular collars 74, 76 in the burner plates 50, 52 are integrally formed with their respective burner plates as by a punching action which need not be described in further detail. Alternatively the burner plates may be made by a suitable casting process.

The diameter of the first or upper burner plate 50 is slightly larger than that of the lower plate 52. The peripheral edges of both plates are formed or turned inwardly toward each other with an annular gap 80 between them. Some gas is allowed to leave the burner head through this annular gap 80 which then mixes with air flowing around the edge of the burner head.

It is noted that the positioning of the burner blower 44 in the manner described above in relation to the burner head provides the benefits of ensuring a balanced air flow all around and through the burner head plates 50, 52. This is in contrast to traditional power burners which require a very much longer distance between the burner blower and the burner head to ensure a balanced flow. The above-noted enclosures which define a path of movement of combustion air from the blower are associated with the flow straightener vanes 48 noted above to provide a smooth and uniform flow of air to the burner head.

Figure 2:
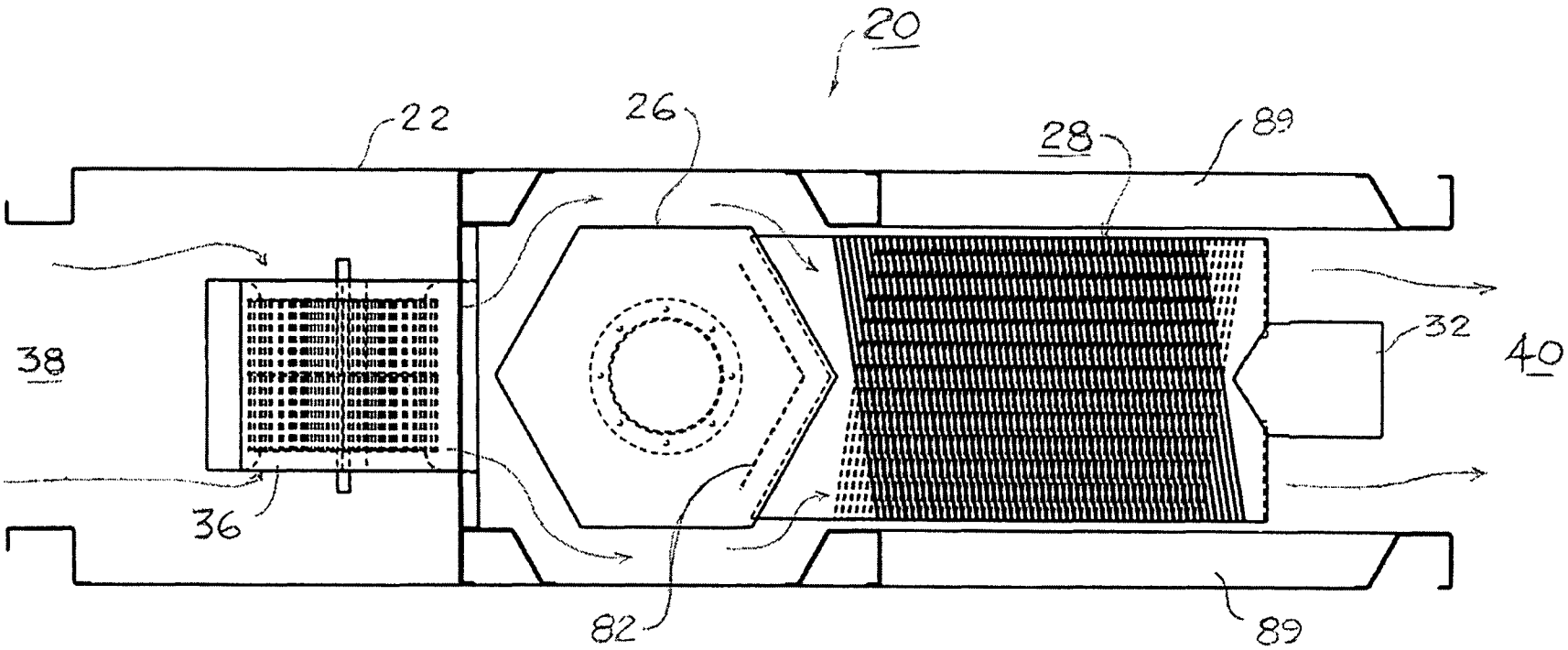
FIG. 2 is a section view taken along line 2-2 of FIG. 1 in a horizontal plane.

A conventional spark igniter part of which is shown as item 81 is attached to the lower burner plate 52 and is used to light the burner in a conventional fashion. During operation, the flames extend downwardly from the burner head into the interior of the combustion chamber 26. The bottom of the combustion chamber 26 is, of course, closed forcing the flames to turn back with the hot combustion gases then made to flow around an elongated metal shield 82 (FIG. 2) which is spaced a reasonable distance away from the above-mentioned series of slot-like openings in the wall of the combustion chamber 26, which openings lead into the heat exchanger sections 30 which will be described hereinafter. It is also noted that although the combustion chamber is shown in the drawings as being of hexagonal outline as seen in plan view, it is quite possible that other shapes, such as a circular shape, might be chosen instead.

Figure 7:
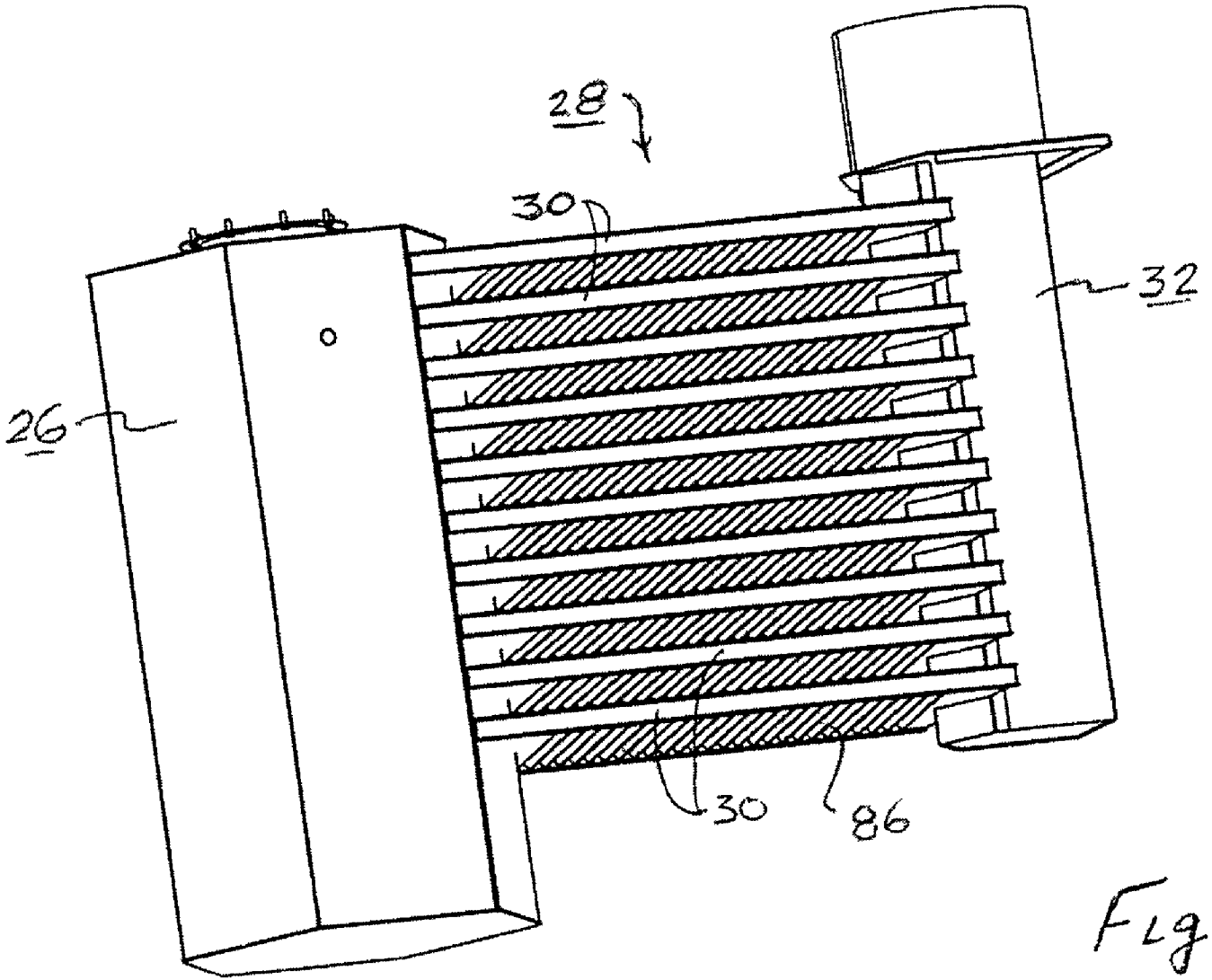
FIG. 7 is a perspective view of the combustion chamber, heat exchanger and exhaust stack assembly looking slightly from below.
Figure 8:
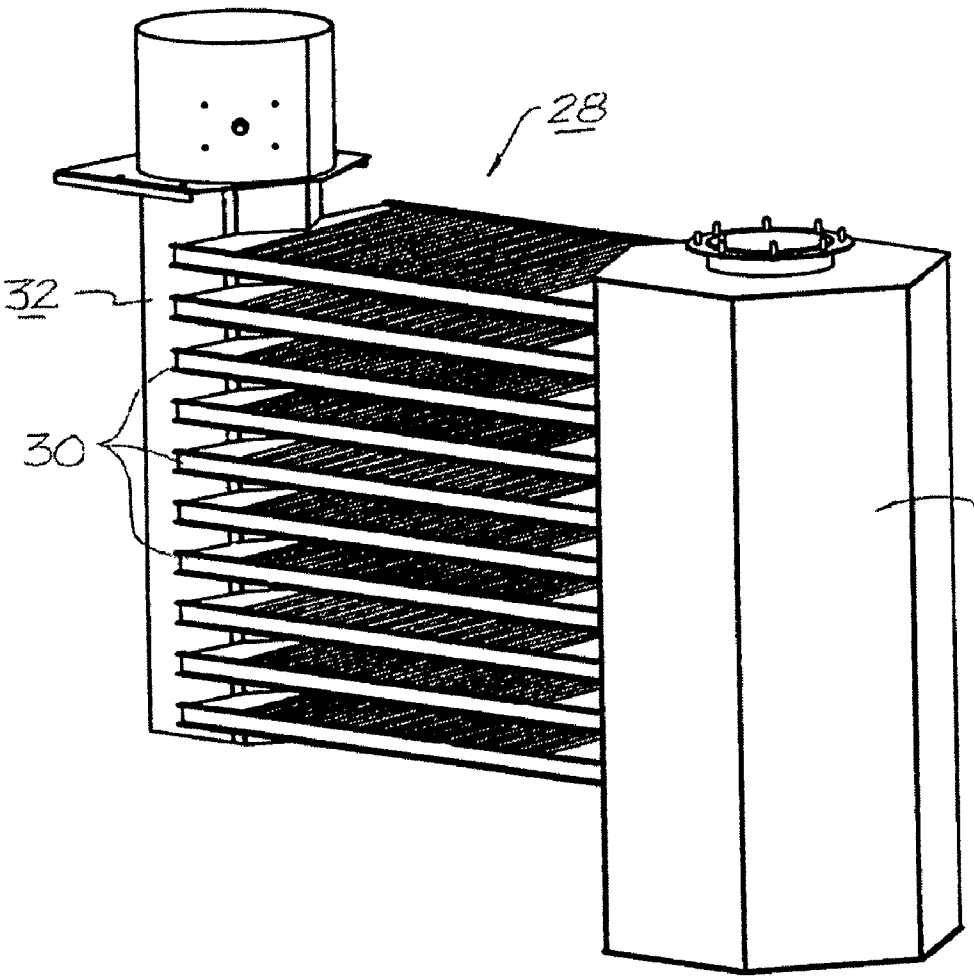
FIG. 8 is a perspective view similar to FIG. 7 but looking somewhat toward to the upper side.
Figure 9:
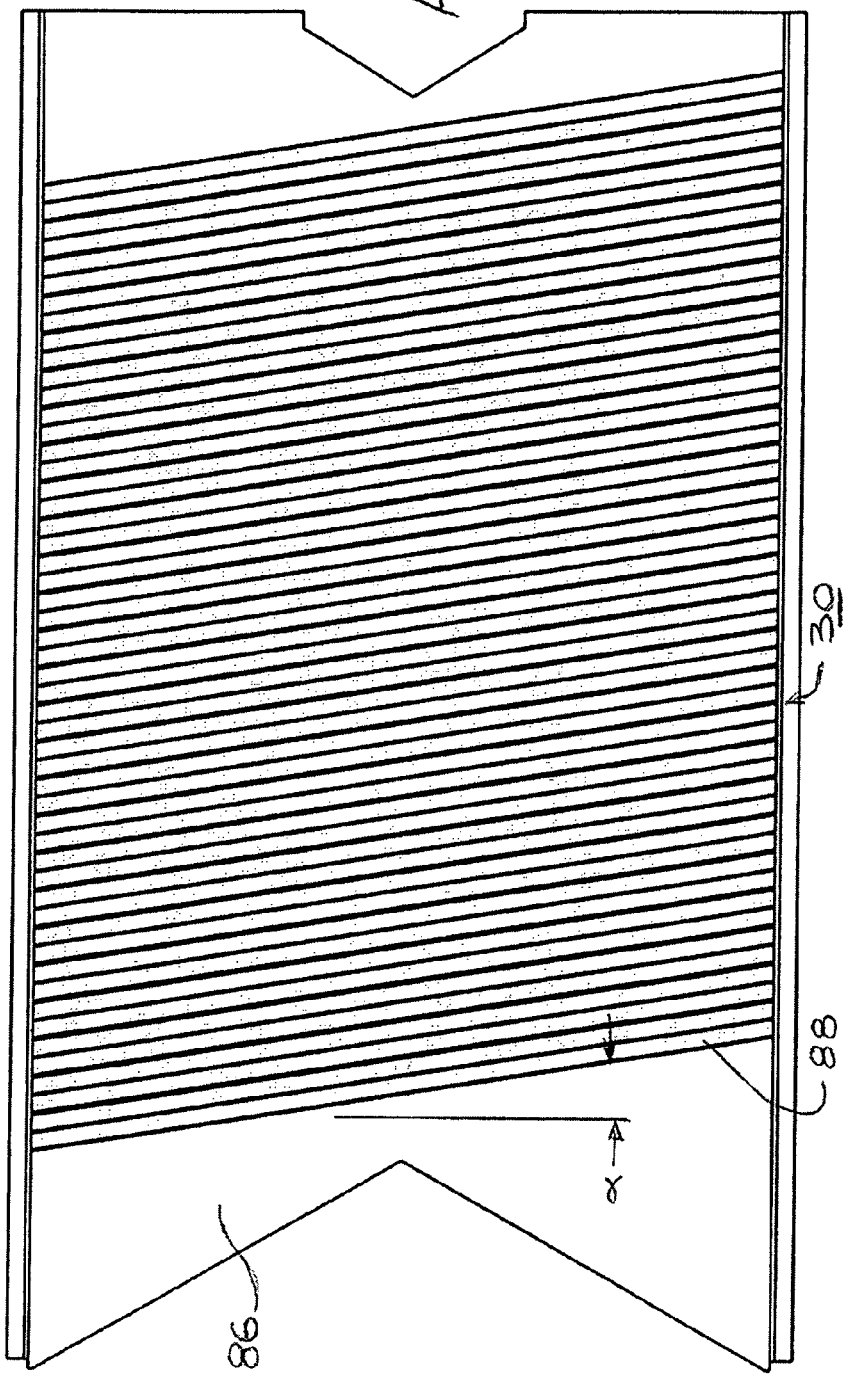
FIG. 9 is a top plan view of a heat exchanger section.
Figure 10:
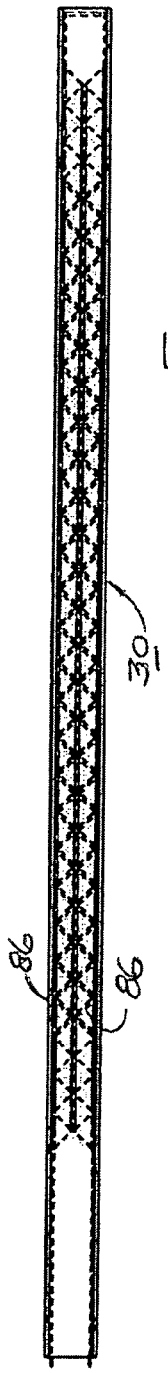
FIG. 10 is a side elevation view of the heat exchanger section.
Figure 12:
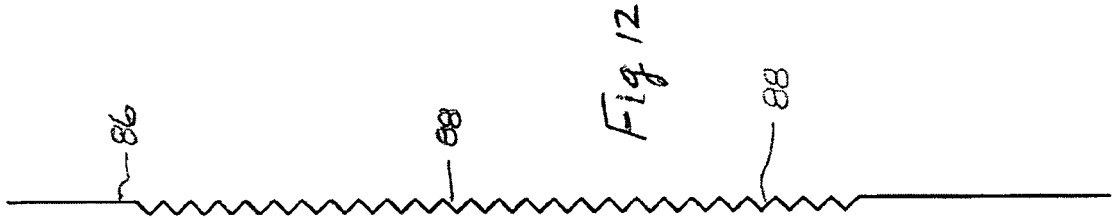
FIG. 12 is a view of the heat exchanger panel seen edge-on showing the corrugations therein.
Figure 11:
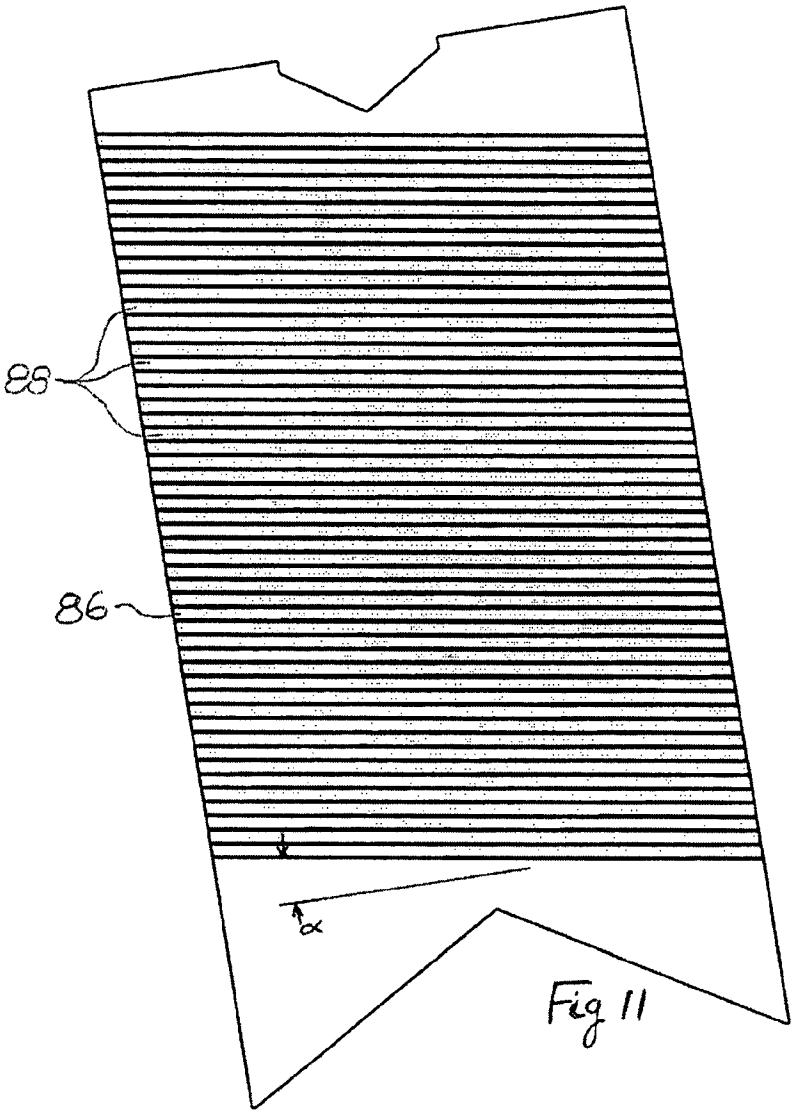
FIG. 11 is a top plan view of a heat exchanger panel.
Figure 13:
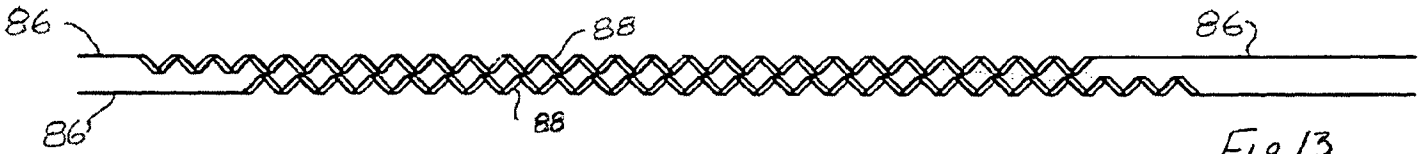
FIG. 13 is a diagrammatic view of a narrow slice of the heat exchanger section taken longitudinally thereof illustrating the face-to-face relationship of the metal panels and the corrugations therein.
Figure 14:
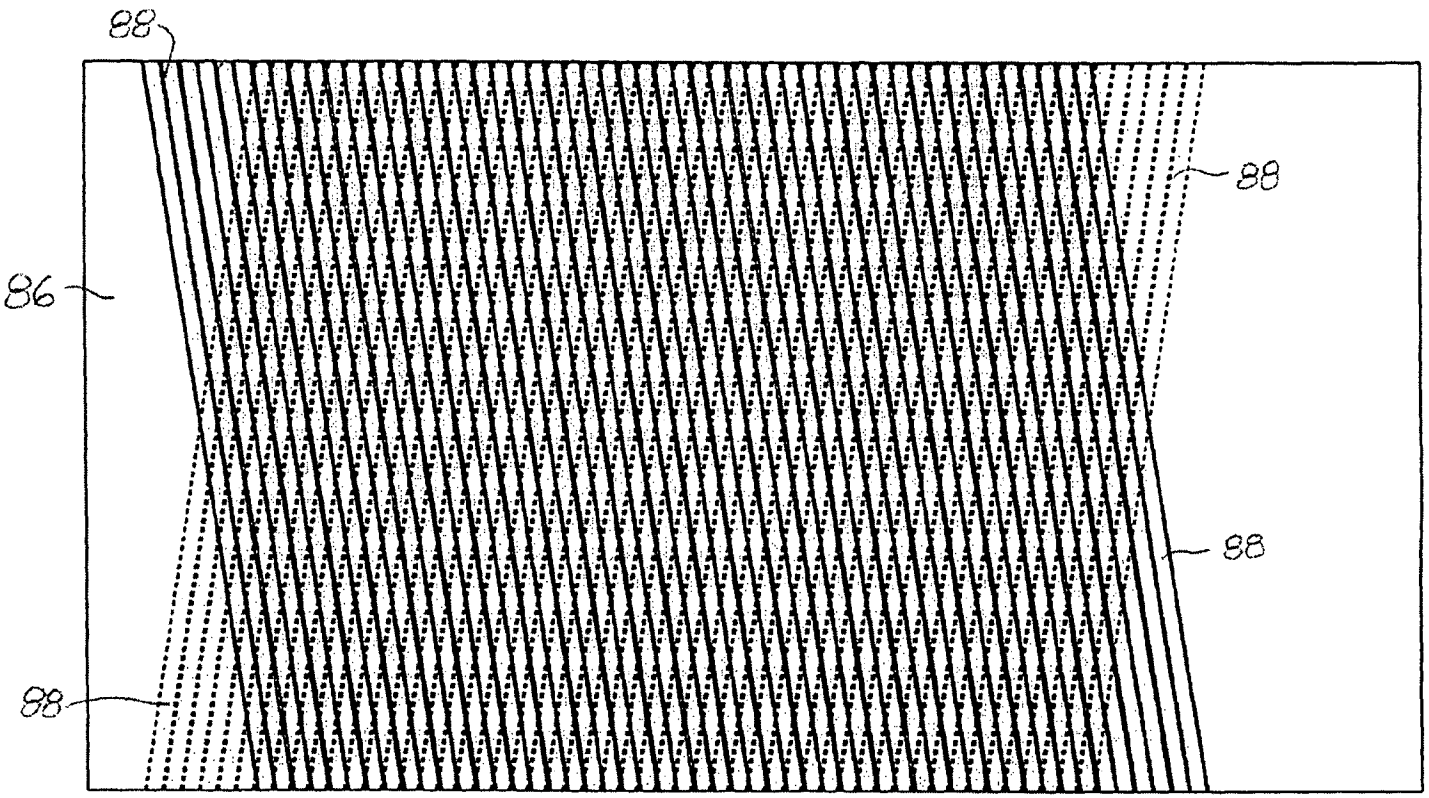
FIG. 14 is a diagrammatic plan view of a heat exchanger section illustrating the panel corrugations therein and their criss-cross relationship.

The heat exchanger 28 comprises a stack of metal exchanger sections 30 which extend away from the combustion chamber 26 and toward the exhaust stack 32 in vertically spaced apart generally horizontal planes (FIGS. 7 and 8). Each heat exchanger section is made from two metal panels 86, preferably of stainless steel to resist corrosion, each metal panel 86 containing a series of parallel V-shaped corrugations 88 which are disposed at an angle $\alpha$ to a line normal to the longitudinal axis of the heat exchanger section 30. In the particular unit noted previously, this angle is in the order of 9° although this angle can be varied considerably (e.g., as for different BTU ratings). These metal panels 86 are attached together in face-to-face relationship such that the peaks of the corrugations are touching or nearly touching (FIG. 10). Because these panels are in close proximity, as the hot combustion gases flow through each of the exchanger sections 30 between the metal panels 86, these gases are forced to flow into the V-shaped channels defined by the corrugations in the panels. It is important to note that the panels 86 are arranged so that the angles of the corrugations 88 therein are oriented so as to be in opposing relationship as between the two panels of each heat exchanger section 30. In other words, adjacent corrugations 88 are in a "criss-cross" relationship to each other (FIG. 14). Thus, if the corrugations are at an angle of about 9° to a line normal to the longitudinal axis of the exchanger section 30, adjacent corrugations 88 will be at an angle of twice this amount, e.g. at about 18° relative to each other, keeping in mind as noted above that these 9° and 18° angles can easily be varied considerably by several degrees. As a result of this relationship, the gases moving through the heat exchanger sections from the combustion chamber 26 to the exhaust stack 32 will be forced to move in a tortuous spiralling path. For example, heated gases entering an upper channel will shift, e.g. towards the right, while gases entering the lower channel will shift toward the left. Eventually the gases in an upper channel will be forced to move to a lower channel and vice versa. Therefore, as these gases move through the heat exchanger sections 30, the gases are shifted right, down, left, and up in a repeating fashion thus taking the form of a series of rough spirals while moving along through the heat exchanger sections. This "spiralling" action of the gases allows for an efficient transfer of heat from the combustion gases to the metal panels 86. The combustion gases then leave the heat exchanger sections 30 and enter through the slot like openings in the exhaust stack 32 and are vented outwardly in any desired manner. The edge portions of the heat exchanger sections 30 are of course sealed to prevent escape of combustion gases and intermixing of same with the air as it is being heated.

The blower assembly 34 for the air to be heated, as mentioned above, is positioned within the main housing 22 on the opposite side of the combustion chamber 26 as the heat exchanger. Cold air is drawn into the previously mentioned cold air inlet 38 in the end wall of the main housing and is sucked into the blower wheels and then expelled from the blower into the main housing interior such that the air first travels around the outside of the combustion chamber 26 (FIG. 2) thus receiving a certain amount of heat therefrom, following which this air then enters the horizontal spaces between the vertically spaced apart heat exchanger sections 30. Thus, this cold air picks up heat from the walls of the combustion chamber 26 as well as the panels 86 of the heat exchanger sections. As the air is flowing longitudinally between the heat exchanger sections 30, the angled corrugations 88 of a heat exchanger section above the air stream force the air in one direction while the corrugations in the section below force it in the opposite direction thus creating a substantial amount of turbulence in the air being heated as it travels lengthwise between the heat exchanger sections 30 thus further improving the efficiency of the heat transfer process. The heated air then exits the heat exchanger 28 and travels outwardly of the main housing 22 by way of the previously mentioned hot air outlet 40 in the exit end of the main housing. It will be obvious that the entrances and exits from the heat exchanger are designed and well sealed to prevent any mixing of combustion gases with the air being heated.

The blower assembly 34 position described above could be changed such that the air travels first through the heat exchanger and then around the combustion chamber. This could provide a more efficient heater but condensation in the exhaust gases is a likely result which would have to be dealt with, which is a reason the preferred configuration described in detail above was adopted.

The previously noted box-like main heater housing 22 includes double walls 89 adjacent to the heat exchanger section (see FIG. 2) forming air chambers between these walls. Louvered openings in the bottom portions of the outer wall panels allow ambient air to enter these chambers. Openings 90 are provided in the top of the housing wall which are positioned near the inlet for the burner blower, it being noted that the burner assembly is itself surrounded by a rectangular box 92. Hence, during operation, the air moves upwardly between the double walls 89 of the main housing 22 thus ensuring that the outer walls remain cool enough as to not pose a hazard to any person making contact with it. Additionally, the upwardly rising warm air allows for some preheating of the inlet air to the burner assembly thus further increasing system efficiency.

A preferred embodiment of the invention has been described by way of example. Those skilled in the art will realize that various modifications and changes may be made while remaining within the spirit and scope of the invention.

Hence the invention is not to be limited to the embodiment as described but, rather, the invention encompasses the full range of equivalencies as defined by the appended claims.

What is claimed is:

1. An air heater comprising a main housing having an air inlet and an outlet for heated air, a combustion chamber located therein, a burner assembly connected to the combustion chamber to supply burning gases thereto, an exhaust stack, a heat exchanger connected to said combustion chamber and comprising a plurality of heat exchanger sections having inlet ends connected to receive heated combustion gases from the combustion chamber and outlet ends connected to said exhaust stack for exhausting combustion gases after passage through the heat exchanger sections, said heat exchanger sections being spaced apart to allow the passage of air therebetween to effect heating of same, and a blower assembly for moving cool air into said main housing via said air inlet and causing the air to travel between the heat exchanger sections and thence outwardly of said outlet for heated air, said burner assembly including an enclosure connected to the combustion chamber and defining a path for movement of combustion air toward the combustion chamber, a pair of generally parallel burner plates located in said enclosure and disposed transverse to the path of combustion air travel, said burner plates being spaced apart to define a shallow chamber therebetween and both plates having a plurality of openings therein allowing for passage of combustion air therethrough, the openings in a first one of said plates being aligned with respective ones of the openings in the second plate to provide annular openings allowing exit of gaseous fuel from the shallow chamber, a conduit to supply gaseous fuel into the shallow chamber defined between said burner plates such that, in use, combustion air moving along the path and through the aligned openings in said burner plates mixes with gaseous fuel emerging from said chamber via said annular openings thereby to provide a combustible fuel-air mixture downstream of said burner plates, which mixture, in use, is ignited to provide the supply of burning gases to said combustion chamber.

2. The air heater of claim 1 wherein said openings in said plates are in the form of short tubular collars projecting from said plates with the tubular collars of both plates being aligned with and directed toward each other in confronting spaced apart relation to provide said annular openings allowing exit of gaseous fuel between the confronting spaced apart collars.

3. The air heater of claim 2 wherein said first burner plate is located upstream of the second burner plate relative to the flow direction of combustion air when in use, and wherein the tubular collars of the first burner plate define flow passages of smaller diameter than those defined by the tubular collars of the second plate thereby to create a venturi-like flow action as the combustion air passes through the aligned tubular collars thus promoting thorough mixing of the air and the fuel being supplied via said annular gaps.

4. The air heater of claims 3 wherein said burner plates are of generally circular outline, with said conduit to supply gaseous fuel being connected centrally of said plates to supply the fuel to the chamber defined between said plates, said conduit having an end portion centrally disposed between said burner plates and having a plurality of radially arranged openings to assist in providing even distribution of gaseous fuel to said chamber.

5. The air heater according to claim 1 including a burner blower communicating with said enclosure to provide for movement of combustion air along said path of travel toward said burner plates and combustion chamber.

6. The air heater of claim 5 wherein said burner blower includes a vaned rotor mounted for rotation on an axis generally centered with said burner plates and extending normal thereto, the burner enclosure having a portion shaped to direct the air flow from said rotor generally along said axis whereby to deliver a generally even and balanced flow toward the burner plates to promote even flow distribution through said openings therein.

7. The air heater of claim 1 wherein said heat exchanger sections each comprise metal panels having corrugations or undulations therein arranged to cause combustion gases moving therethrough to move in a turbulent fashion to enhance transfer of heat from the gases to the metal panels.

8. The air heater of claim 7 wherein said heat exchanger sections are disposed in use, in vertically spaced horizontal planes to provide for said passage of air along spaced horizontal planes during heating thereof.

9. The air heater of claim 1 wherein each said heat exchanger section comprises a pair of metal panels disposed in close face-to-face relation to allow gases to flow therebetween from the inlet ends to the outlet ends in the travel direction, said panels each having corrugations therein angled relative to the travel direction and oppositely oriented with respect to each other such that adjacent corrugations are in a criss-cross relation to each other whereby gases flowing between said panels are forced by the opposing corrugations to move in the form of a series of repeating spirals from said inlet end to said outlet end to provide enhanced transfer of heat.

* * * * *